US005660352A

United States Patent [19]

Dicken et al.

[11] Patent Number: 5,660,352

[45] Date of Patent: Aug. 26, 1997

[54] MANDREL SLEEVE ADAPTOR

[75] Inventors: Dale H. Dicken, Westlake; Thomas M. Pituch, Aurora, both of Ohio; Francis N. Smutney, Washington, Pa.

[73] Assignee: L-S Electro-Galvanizing Company, Cleveland, Ohio

[21] Appl. No.: 425,408

[22] Filed: Apr. 20, 1995

Related U.S. Application Data

[62] Division of Ser. No. 162,361, Nov. 22, 1993, Pat. No. 5,441,212, which is a continuation of Ser. No. 750,965, Aug. 28, 1991.

[51] Int. Cl.[6] ..... B65H 18/00

[52] U.S. Cl. ..... 242/534

[58] Field of Search ..... 242/532, 532.7, 242/534, 613, 613.1

[56] References Cited

U.S. PATENT DOCUMENTS

| | | |
|---|---|---|
| 2,779,547 | 1/1957 | Roberts et al. . |
| 2,953,313 | 9/1960 | Csustor . |
| 3,447,674 | 6/1969 | Fraser . |
| 4,146,188 | 3/1979 | Hewinson et al. . |
| 4,350,309 | 9/1982 | Richard et al. . |
| 4,577,811 | 3/1986 | Bray et al. . |
| 4,736,605 | 4/1988 | Klockner et al. . |
| 4,832,276 | 5/1989 | Gabhardt et al. . |

FOREIGN PATENT DOCUMENTS

| | | | |
|---|---|---|---|
| 1442227 | 5/1966 | France . | |
| 1453686 | 8/1966 | France . | |
| 4210070 | 5/1967 | Japan . | |
| 464059 | 2/1971 | Japan . | |
| 074442 | 5/1983 | Japan . | |
| 60-72612 | 4/1985 | Japan | 242/532 |
| 2-263515 | 10/1990 | Japan | 242/534 |
| 3-8669 | 1/1991 | Japan | 242/534 |

*Primary Examiner*—John P. Darling

*Attorney, Agent, or Firm*—Watts, Hoffmann, Fisher & Heinke

[57] ABSTRACT

A method for eliminating the problem of head or lead end creasing in coiled materials includes fitting a coiling mandrel with a mandrel sleeve adaptor. The sleeve adaptor includes a narrow soft zone which is more compressible than the remainder of the outer surface of the adaptor. When the head end of the material to be coiled nests in the narrow soft zone during coiling the problem of creasing is eliminated.

9 Claims, 2 Drawing Sheets

MANDREL SLEEVE ADAPTOR

This is a division of application Ser. No. 08/162,361, filed Nov. 22, 1993, now U.S. Pat. No. 5,441,212, which is a continuation of appln. Ser. No. 07/750,965, F. Aug. 28, 1991.

BACKGROUND OF THE INVENTION

1. Field of the Invention

The present invention relates to a means and method for eliminating the creases which are formed during coiling in the initial wraps of wound or coiled materials by the lead or head end of the material. When winding or coiling materials onto the mandrels of tension reels, creases are often promulgated through the first several wound layers because the lead or head end of the material which rests on the mandrel transmits its impression into the initial layers.

Those lengths of the coiled material having creases in them cannot be used to make finished parts whose acceptability depends upon their having a smooth unblemished surface. The electrogalvanized steel sheet which is used for exposed panels in automobiles, refrigerators, washing machines and the like is one such material which in its processing must be coiled and is susceptible to creasing. For ease of explanation, this invention will be described with respect to electrogalvanized steel although it should be understood that it is applicable to other materials which are susceptible to creasing when coiled such as, for example, aluminum, copper, plastic and the like.

In the case of electrogalvanized steel strip, the head of the coil causes an impression the width of the coil to be transmitted through about the first 100 laps, or several inches, of the coil inner diameter as it is wrapped on the tension reel. This impression causes surface defects in the finished product which result in about 180 to 300 feet of steel strip having to be scrapped.

The instant invention entirely eliminates the problem of creasing by advantageously employing a combination of proximity sensors and a unique mandrel sleeve adaptor, or boot, having a narrow soft zone disposed therein. The instant invention advantageously coordinates the head end of the strip with the soft zone on the mandrel sleeve adaptor to quickly and effectively wind or coil the material while eliminating the problem of creasing.

2. Description of Related Art

The broad concept of providing a mandrel or tension reel with a soft covering to avoid creasing in subsequent wraps is known. Moreover, dual hardness mandrel sleeves have been used which have a firm inner coating covered by a soft outer coating. These attempts, however, have not adequately solved the problem of creasing because they do not provide for the head end of the strip to be embedded in the sleeve or boot to a significantly greater extent than the rest of the strip. With prior art methods, the entire boot is compressed. If the strip is tightly wound the compressed rubber boot cannot absorb the head end and a crease is formed in subsequent wraps. If the strip is wound loosely, the inner diameter of the coil collapses and the customer can not insert their mandrel for subsequent uncoiling of the product.

SUMMARY OF THE INVENTION

To overcome the problems associated with creasing, the instant invention provides an improvement for coiling mandrels comprising a sleeve adapter having an elongated zone for engaging the head end of the material to be wrapped. The zone constitutes a narrow portion of the outer circumference of the sleeve adaptor and is more compressible than the remaining portion of the outer surface, whereby the head end of the material is depressed into the adaptor surface at the more compressible or soft zone in order to eliminate creasing of superimposed wraps.

Although the sleeve adaptor can be made of a single layer of an elastomeric material, in a preferred embodiment the sleeve adaptor comprises inner and outer layers of elastomeric material, said outer layer being softer than said inner layer and having an axially elongated zone for contacting the head end of the material to be wrapped. Whether the sleeve is comprised of a single layer or multiple layers, the zone constitutes a narrow portion of the outer surface of the outer layer and is more compressible than the remaining surface portion. The head end of the material to be coiled is thus depressed into the adaptor surface at the more compressible or soft zone in order to eliminate creasing of superimposed wraps.

In a preferred embodiment the sleeve adaptor is incorporated into a coiling apparatus comprising a coiling mandrel, delivery means for delivering a material to the mandrel and means for causing said material to coil around the mandrel. The preferred apparatus includes a first means for sensing the position of the head end of said material relative to the coiling mandrel, and a second means for sensing the rotative position of the soft zone.

A further object of the present invention is a method of eliminating head end creasing in coiled materials comprising the steps of feeding a length of material to be coiled toward a coiling mandrel, sensing the rotational location of an axially elongated soft zone formed on the outer surface of the mandrel by a mandrel sleeve adaptor, sensing the location of the head end of the material to be coiled relative to the mandrel, engaging said soft zone with the head end of the material to be coiled, and coiling the material.

It is still more preferable to employ a narrow soft zone. By employing a narrow soft zone, creasing is eliminated without the formation of a flat spot in the internal diameter of the coil which results in the coil not fitting the customers mandrels for uncoiling the material. Advantageously, this invention permits the coiling in either the clockwise or counterclockwise direction These and other objects of the instant invention will become clear to one of ordinary skill in the art in view of the following disclosure.

DETAILED DESCRIPTION OF THE INVENTION

Figure 1:
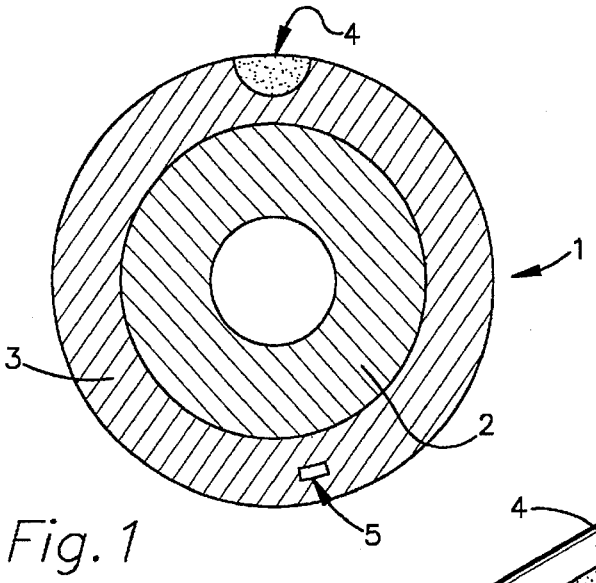
FIG. 1 is a stylized end view of a mandrel sleeve adaptor according to the invention.
Figure 2:
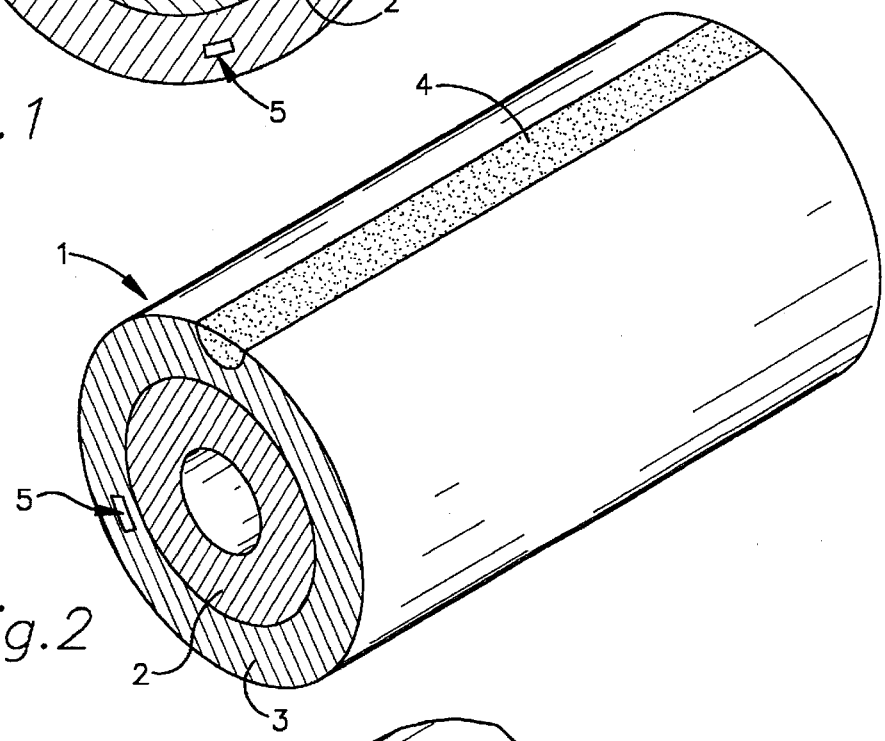
FIG. 2 is a stylized perspective view of a mandrel sleeve adaptor according to the invention.
Figure 3:
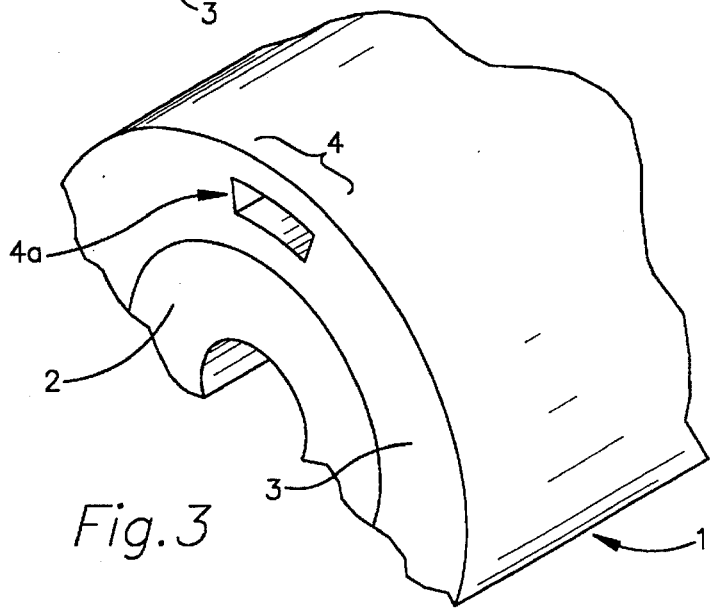
FIG. 3 is a stylized perspective view of a different aspect of a mandrel sleeve adaptor.

In accordance with a first aspect of the instant invention there is provided a mandrel sleeve adaptor 1. This adaptor is in the form of a sleeve which fits onto and covers the circumference of the mandrel of a tension reel. It should be recognized that this adaptor would be adaptable to other reel or mandrel types wherein the problem of lead end creasing occurs. As shown, the mandrel sleeve adaptor 1 is comprised of an inner layer 2, an outer layer 3 and a soft zone 4, a dual layer sleeve being a preferred embodiment. The inner layer 2 and the outer layer 3 are made of an elastomer such as, for example, rubber with the inner layer 2 having a higher durometer than the outer layer 3. Similarly, the outer layer 3 is harder, has a higher durometer and/or less elasticity than the soft zone 4. Thus, the soft zone is more compressible than the rest of the outer layer.

In a preferred embodiment the durometer of the inner layer is about 60 to about 90, the durometer of the outer layer is about 45 to about 60, and that of the soft zone is about 30 to about 45. The durometer of the respective layers may, however, be varied according to need as the materials to be coiled change.

The soft zone 4 preferably runs the axial length of the sleeve adaptor although it is only essential that the soft zone be as long as the width of the product being coiled. The width of the product will vary in accordance with several factors: such as the size of the rolling mill, size of the galvanizing facilities and customer needs. For example, a common product width in the steel industry is 72 inches for the width of the coiled steel.

Generally, the soft zone should be as narrow as possible while still permitting the head end to be embedded in its surface and not unduly restricting the ability to locate the head end on it at the operating speed of the processing line of which the coiler is a part. Usually the soft zone is between 0.50 and 2.5 inches in width. As the size of the mandrel increases, the surface speed of the sleeve for any given rotational speed increases and the difficulty of locating the head end on the soft zone increases. Generally, however, the soft zone should be between 0.4% and 5.0% of the circumference of the sleeve. The critical parameter of the width, as measured circumferentially on the sleeve adaptor, is that the soft zone is not wide enough to create a flat spot in the inner circumference of the coil. If the soft zone is too wide, the portion of the inner diameter of the coil that bridges the soft spot will lay flat across it. The flat spot causes two creases or dimples in the coil, one at each end of the flat spot. This makes it difficult for the customer to mount the coiled product on their uncoiling mandrels and also results in the initial wraps of the coil having to be scrapped.

The soft zone may be formed in the outer layer of the mandrel sleeve adaptor in various ways. In one method, a groove may be introduced into the outer layer and fitted with a strip of elastomer having a lower durometer than said outer layer. The soft zone strip may be adhered to the groove in the outer layer by adhesives or other known fastening means. As used herein, the term elastomer means any substance, such as rubber, plastics and polymers, that possesses elasticity and that can be made into a sleeve. The selection of appropriate elastomers is well within the skill in the art in view of the instant disclosure.

In another method, the outer layer of the adaptor is made in two steps the first of which is the forming of a thin layer over the inner layer 2. A thin metal strip equivalent to the width 0f the desired soft zone is then laid across the width of the mandrel sleeve. Finally, another thin layer of elastomer having the same durometer as the previous thin layer is formed over the metal strip. After the outer layer has been cured, the metal strip is removed to leave a void 4*a* which creates a soft zone running the axial width of the mandrel. Thus, said thin layers integrally form said outer layer 3. Similarly, several small strips may be used to form a plurality of voids.

The nature of the soft zone is not critical so long as it comprises a narrow segment of the circumference of the mandrel sleeve adaptor which is softer and thus more compressible than the remainder of the outer surface. Means of producing the soft zone and mandrel sleeve adaptor are well within the skill in the art employing conventional rubber and polymer manufacturing techniques.

As noted above, the instant invention allows coiling in either direction. That is, the product strip can have an overwind or an underwind, so that the product can be uncoiled in either a clockwise or counter clockwise direction. The customer need only specify how the product should be coiled.

The adaptor 1 also comprises a means 5 capable of being sensed by a proximity sensor located on the coiling apparatus. Preferably, the means 5 is a small piece of metal which may be located radially on the end of the mandrel adaptor at a predetermined location relative to the location of the soft zone. In this embodiment the small metal piece can rotate with the mandrel sleeve adaptor past a non-contact proximity switch or sensor so that the position of the soft zone can be determined and dictated at any given time. It should be recognized that other equivalent sensing and coordinating means would be suitable for the invention; for example, a bar code and bar code reader combination or photo sensors.

The overall dimensions of the adaptor of the instant invention are for the most part dictated by industry standards for the size of tension reels and mandrels. For example, in the United States there are typically four standard mandrel sizes which are used, regardless of the industry or technology. The most common mandrel size has a 24 inch diameter. Other standard mandrel diameters are 16, 20 and 36 inches. Consequently, the thickness of the instant mandrel sleeve adaptor in an ambient state i.e. neither stretched nor compressed, is selected to result, when installed on the mandrel, in a finished outside diameter of one of the standard mandrel sizes.

In a preferred embodiment, the inner diameter (I.D.) is 20 inches and the outer diameter (O.D.) is about 24 inches, the circumferential thickness of the sleeve adaptor therefore being about 2 inches. In this embodiment, the inner layer, 2, is about 1 inch thick and the outer layer, 3, is about 1 inch thick. Further, when the soft zone is produced by creating a void in the outer layer, the thickness of the layer over the void is preferably about ¼ to about ⅜ inches deep in the radial direction from the outer surface of the sleeve adaptor and the void itself is about 0.05 inches high in the radial direction and about 2 inches wide in the circumferential direction. The thickness of the sleeve and the various layers may, of course, vary depending on the materials used.

Figure 4:
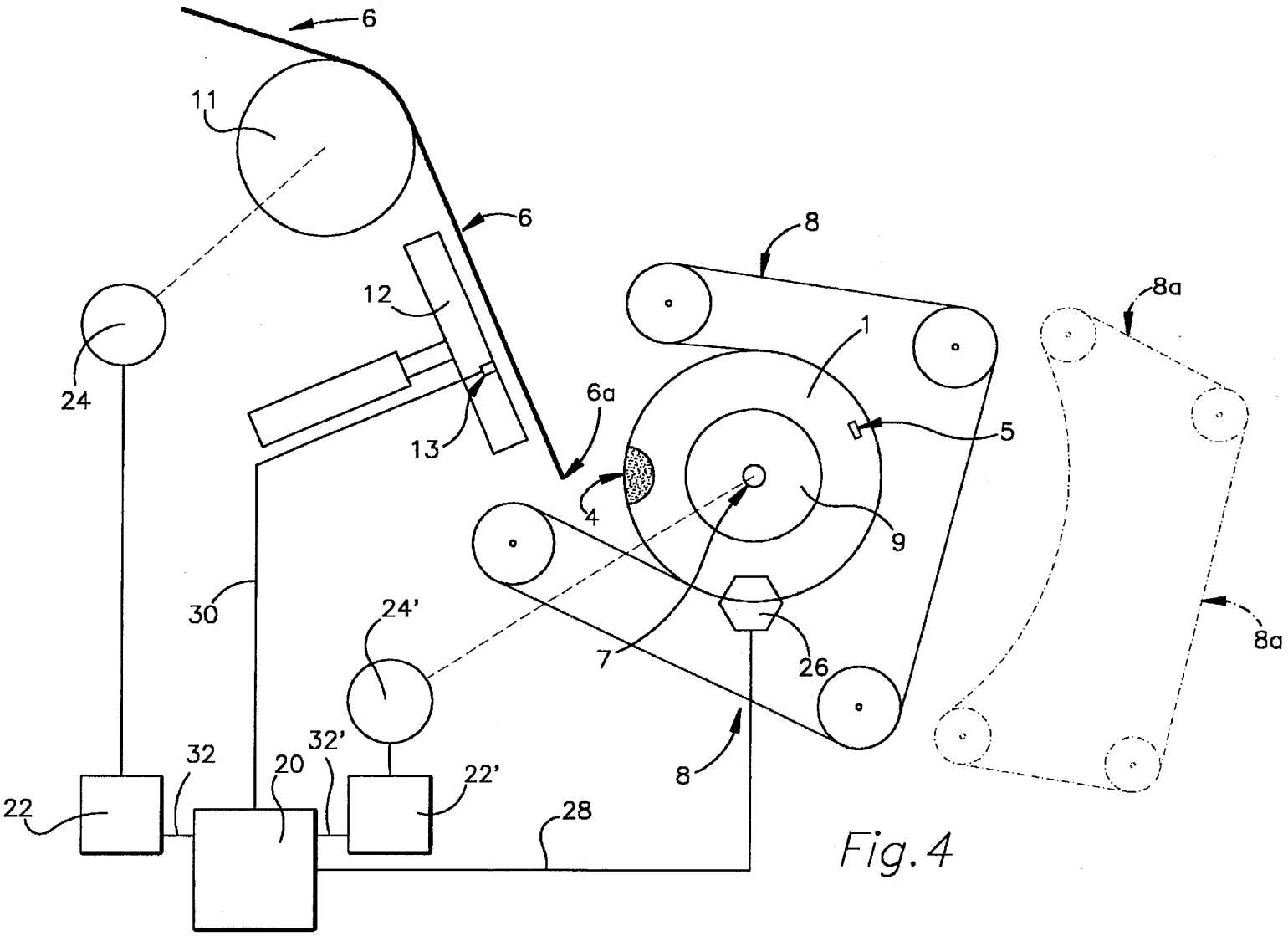
FIG. 4 is a stylized schematic of the mandrel sleeve adaptor in the environment of use.

Turning now to FIG. 4, the instant mandrel sleeve adaptor is used in combination with the proximity sensors to assure that the lead end of the strip is located on the soft zone of the adaptor and thus, eliminate the problem of tension reel creases.

In addition to the proximity sensor 26 which detects the position of the soft zone on the mandrel sleeve adaptor, a second non-contact swish or sensor 13 is located before the coiling apparatus which can sense the location of the head end of the strip of material as it approaches the coiler. This sensor may be located, for example, in the deflector table which guides the strip of material to be coiled toward the coiling mandrel. The rotation of the take up (coiling) mandrel which is fitted with the instant adaptor, is thus coordinated with the feed of the strip so that the end of the strip is laid on the mandrel at the soft zone. By prepositioning the soft zone of the mandrel sleeve adaptor to a position sensed by a proximity sensor, and synchronizing the tension reel rotation to position the head end of the material at the soft zone with a second proximity sensor, the advantageous use of a narrow soft zone becomes possible. By this method, the positioning of the head end of the strip can be easily controlled to within ±½ inch. Moreover, the problem of creasing can be eliminated without serious detriment to the high production speeds associated with modern coiling apparatus.

When seeking to eliminate creasing, it is beneficial, once the head end has been located on the soft zone to wrap at least the first few wraps, usually two, at a reduced belt wrapper tension. This reduces the compression on the outer rubber layer of the adaptor and the soft zone so that the soft zone can perform its absorbing function. Once the initial wraps have been made, the tension (wrapping pressure) may be increased to production standards. It is well known to those skilled in the art that the rolling speed and pressure may vary depending upon the selected gauge, width and other product specifications of the material to be coiled, whether it is metal, plastic or other strip material.

More specifically, the process begins when a delivery operator initiates the sequence which feeds the steel strip to be coiled 6 to the tension reel 7. Here, a belt wrapper 8 moves from a home position shown in dotted lines 8*a* and wraps around the instant mandrel sleeve adaptor 1 which is mounted on the tension reel mandrel 9.

Once the belt wrapper is in position, the tension reel and mandrel sleeve adaptor rotate until a sensor 26 senses the metal indicator piece 5 in or on the mandrel sleeve adaptor indicating the position of the soft zone 4. Once the metal indicator piece has been detected, a signal, shown schematically as input 28, is sent to a microprocessor 20 which then communicates via output 32' and motor control 22' with motor 24', which drives the tension reel mandrel 9 and rotation of the mandrel is stopped with the soft zone in a specific known position in the rotation of the mandrel. The steel strip is now ready to be fed via a deflector roll 11 or other feeding means onto the tension reel mandrel. Typically, a deflector roll transfers the strip across an exit deflector table 12 at a predetermined speed. The head of the strip 6*a* is sensed by a second proximity sensor 13 which is typically located in the deflector table. Once the head end of the strip is detected, a signal, shown schematically as input 30, is sent to microprocessor 20 which initiates rotation of the tension reel and mandrel sleeve adaptor. The micro processor coordinates the speed of the strip by communicating with the motor 24 through output 32 and motor control 22, with the acceleration and steady state rotation of the tension reel so that the head end of the steel strip is accurately positioned onto the soft zone of the mandrel sleeve adaptor at high speed.

The belt wrapper guides the strip to be coiled to the soft zone. While the strip is moving toward the sleeve adaptor, the tension reel rotates in the direction of the strip travel. After several wraps of the strip onto the tension reel mandrel, the belt wrapper returns to its home position, delivery tension control is energized, and the tension reel accelerates to the delivery speed determined by the delivery automatic control which is programmed for the product specifications.

We claim:

1. A method of eliminating head end creasing in coiled materials comprising the steps of:

a) feeding a length of material to be coiled to a coiling mandrel, b) sensing the rotational location of an axially elongated more compressible zone formed on an outer surface of a mandrel sleeve adaptor disposed on the mandrel, c) sensing the location of a head end of said material relative to the mandrel, d) engaging said more compressible zone with the head end of said material, and e) coiling said material.

2. The method according to claim 1, including wrapping initial wraps of said material onto said adaptor at a lesser tension than subsequent wraps of said material.

3. The method according to claim 1, wherein the head end is positioned to within ±½ inch of said more compressible zone.

4. The method according to claim 1, further comprising engaging the head end with said zone which comprises a portion of said adaptor located radially outward of an axially extending void formed in said adaptor.

5. The method according to claim 4, further comprising engaging the head end with said adaptor which comprises an outer layer of elastomeric material disposed outward of an inner layer of elastomeric material, said outer layer being more compressible than said inner layer.

6. A method of eliminating head end creasing in coiled materials comprising the steps of:

a) feeding a length of material to be coiled to a coiling mandrel, b) sensing the rotational location of a more compressible zone formed on an outer surface of a mandrel sleeve adaptor disposed on the mandrel, said zone being an axially elongated portion of an outer surface of said adaptor that is more compressible than the remaining portion of the outer surface of said adaptor;

c) sensing the location of a head end of said material relative to the sensed rotational location of said zone, d) engaging said zone with the head end, and e) coiling the material on said adaptor.

7. The method according to claim 6, further comprising engaging the head end with said zone which comprises a portion of said adaptor located radially outward of an axially extending void formed in said adaptor.

8. The method according to claim 6, further comprising engaging the head end with said adaptor which comprises an outer layer of elastomeric material disposed radially outward of an inner layer of elastomeric material, said outer layer being more compressible than said inner layer.

9. The method according to claim 8, further comprising engaging the head end with said zone which comprises a portion of said adaptor located radially outward of an axially extending void formed in said adaptor.

* * * * *